United States Patent [19]

Erickson

[11] Patent Number: 4,796,431

[45] Date of Patent: Jan. 10, 1989

[54] NITROGEN PARTIAL EXPANSION REFRIGERATION FOR CRYOGENIC AIR SEPARATION

[76] Inventor: Donald C. Erickson, 1704 S. Harbor La., Annapolis, Md. 21401

[21] Appl. No.: 885,868

[22] Filed: Jul. 15, 1986

[51] Int. Cl.[4] ..... F25J 3/04

[52] U.S. Cl. ..... 62/31; 62/34; 62/39; 62/44

[58] Field of Search ..... 62/11, 22, 23, 24, 29, 62/36, 38, 39, 40, 42, 43, 44, 27, 28, 31, 34

[56] References Cited

U.S. PATENT DOCUMENTS 4,578,095 3/1986 Erickson ..... 62/22
4,582,518 4/1986 Erickson ..... 62/39 X
4,662,917 5/1987 Cormier, Sr. et al. ..... 62/43 X

*Primary Examiner*—Steven E. Warner

[57] ABSTRACT

The invention provides a means of producing at least one of high purity nitrogen and low to medium purity oxygen (up to about 97% purity) at high recovery (above 96% for oxygen). The LP column efficiency is improved to reduce the energy requirement, without offsetting reduction in $LN_2$ reflux availability. Referring to FIG. 1, this is done by providing intermediate height reboil to LP column 3 by a latent heat exchanger 10 in which HP rectifier 5 overhead $N_2$ vapor which has been partially expanded in expander 9 is condensed and kettle liquid is evaporated. The condensed $N_2$ is then used to reflux column 3 after depressurization by valve 13.

20 Claims, 7 Drawing Sheets

NITROGEN PARTIAL EXPANSION REFRIGERATION FOR CRYOGENIC AIR SEPARATION

DESCRIPTION

1. Technical Field

This invention relates to processes and apparatus for separating air into at least one of nitrogen and low to medium purity oxygen via cryogenic distillation. The invention makes possible a substantial reduction in the energy hitherto required for these products, by increasing the efficiency of the distillation step.

2. Background Art

Conventional cryogenic air separation processes normally involve at least two distillation columns: a "low pressure" column, from which is withdrawn fluid oxygen bottom product of specified purity plus gaseous nitrogen overhead product, plus a "high pressure rectifier" which receives the feed air, provides reboil to the LP column and $LN_2$ reflux for both columns by indirect exchange of latent heat between the two columns, and provides oxygen enriched liquid air feed (kettle liquid) to the LP column.

The conventional flowsheets provide the bulk of the refrigeration necessary for the process in either of two conventional manners: by work expanding either part of the HP rectifier overhead $N_2$ to nitrogen exhaust pressure (slightly below LP column overhead pressure), or expanding part of the feed air to LP column intermediate height pressure. U.S. Pat. 3,327,488 illustrates the above two approaches in the same flowsheet, although for economic reasons usually only one or the other is used.

The kettle liquid is low in $O_2$ content, for example about 35% $O_2$. When kettle liquid is the primary feed to the LP column and there is only a bottoms reboiler, the bottom section of the column is very inefficient, i.e., has much more reboil than necessary. At least two methods have been disclosed in the prior art for reducing this inefficiency. U.S. Pat. No. 4,254,629 discloses a configuration wherein one or two additional columns are incorporated in order to evaporate at least part of the kettle liquid before being fed to the LP column. U.S. Pat. Nos. 2,753,698, 3,270,514, and 4,208,199, disclose simpler approaches to the same objective. Secondly, it is possible to provide intermediate reboil to the LP column in addition to bottoms reboil. Numerous prior art references describe this technique, including U.S. Pat. Nos. 3,210,951, 3,277,655, 3,251,190, 3,371,496, 3,688,513, 4,578,095, and 4,582,518.

Both of the techniques described above, as disclosed in the references, cause a serious reduction in the amount of $LN_2$ reflux available to the LP column. This severely limits recovery.

The majority of the overhead product of the HP rectifier, fairly pure nitrogen, is normally withdrawn as liquid for further cooling and subsequent direct injection into the LP column as overhead reflux therefor. Frequently a minor amount of gaseous $N_2$ is also withdrawn: for expansion to produce refrigeration; for further compression and then recycle in an external heat pump (liquefaction cycles); or as a minor product directly. When withdrawn as either minor product or for refrigeration expansion, it causes a one-for-one reduction in the $LN_2$ available for LP column reflux.

It is known to use the power developed by the refrigeration expander to drive a warm end compressor, for example in a compander configuration. See, for example, U.S. patent application Ser. No. 853,461 filed 04/18/86 by Donald C. Erickson, which is incorporated by reference. It is also known to incorporate a cold expander driving a cold compressor, whereby no net refrigeration is obtained. U.S. Pat. No. 4,072,023 illustrates this, showing cold compression of either the oxygen product or the supply to the HP rectifier.

What is needed, and a primary objective of this invention, is process and apparatus whereby the efficiency of the lower section of the LP distillation column is improved by at least one of intermediate reboiling and kettle liquid evaporation, but without the accompanying substantial decrease in $LN_2$ reflux availability which has heretofor accompanied such improvement. More particularly it is desired to exchange the energy (excess reboil) presently wastefully consumed in the bottom section of the LP column for useful refrigeration work, thus minimizing or eliminating the need to expand $N_2$ vapor all the way to exhaust pressure to provide necessary refrigeration.

DISCLOSURE OF INVENTION

The above and other useful objects are provided by process and apparatus wherein a majority of the HP rectifier overhead product nitrogen is withdrawn as vapor, slightly superheated as appropriate for a compensating stream, work expanded to an intermediate pressure above the LP column pressure and then supplied to a latent heat exchanger supplied with either of two evaporating liquids: LP column intermediate height liquid, or kettle liquid which has been depressurized to the approximate LP column pressure. The evaporated fluid adds to the intermediate reboil flow rate of the LP column, and the liquid $N_2$ condensate is routed preferably to the LP column overhead as direct injection reflux, and in some cases part may be pressurized and returned to the HP rectifier overhead as reflux therefor.

In the above manner the $N_2$ vapor flowing through the expander is in lieu of reboil vapor which would otherwise flow through the LP column between the bottoms reboiler and the point of introduction of evaporated fluid. Since the reboil would otherwise be wasted in the column (i.e., not necessary for the desired separation), the work obtained at the $N_2$ expander is "free", i.e., at no additional input energy cost. The practical advantage is that the conventional expander flow is no longer necessary. Since that conventional flow bypasses either the HP rectifier (air expansion) or the LP column ($N_2$ expansion), and hence represents a loss of separating power (i.e., $LN_2$ reflux), the new process avoids that loss. Thus various low energy or high efficiency flowsheets become possible which without the disclosed improvement would suffer offsetting low recovery due to lack of availability of sufficient $LN_2$ reflux.

With the disclosed process, subjecting $N_2$ to partial expansion vice a gas with substantial $O_2$ content provides two important advantages. First, a given reboil rate up the HP rectifier yields more $N_2$ than a lower pressure $O_2$-containing gas. Second, since the $N_2$ pressure is higher, the piping and heat exchange pressure drops are less severe, and heat transfer coefficients are improved. Also, the low pressure ratio expansion allows a very efficient expander.

In general, any flowsheet incorporating nitrogen partial expansion refrigeration (NIPER) can utilize either variation described above. When $N_2$ is condensed directly against LP column intermediate height liquid, the latent heat exchanger may be located either internal to or external to the column. Internal location is preferred in order to balance liquid flow rates without a pump. When kettle liquid is evaporated, external location is indicated and no pump is necessary. Hence overall LP column height may be reduced.

NIPER is particularly useful for producing low purity oxygen (up to about 97% purity) (see below under Best Mode) and/or high purity nitrogen. It is not a preferred method of producing argon coproduct. It is particularly advantageous when incorporated in conjunction with other energy-saving or recovery-enhancing measures, since it tends to minimize disadvantageous side effects which would otherwise be present. Examples of other measures are presented in the figures.

BRIEF DESCRIPTION OF THE DRAWINGS

FIG. 5 is for high purity $N_2$ as major product, and all the others are for low purity $O_2$.

FIGS. 1, 6, and 7 illustrate depressurized kettle liquid being evaporated by the condensing $N_2$, and the remaining figures illustrate LP column intermediate height liquid being evpaorated (internal to the LP column). FIGS. 4 and 5 illustrate LP column bottom reboil by latent heat exchange with HP rectifier overhead vapor; in FIGS. 1, 2, 3, and 7 it is by partial condensation of supply air; and in FIG. 6 it is by total condensation of a companded minor fraction of the supply air. Other distinctions between the flowsheets include how product $O_2$ is evaporated, presence of kettle liquid split, and presence of liquid air split. These are elaborated upon below.

BEST MODE FOR CARRYING OUT THE INVENTION

Figure 1:
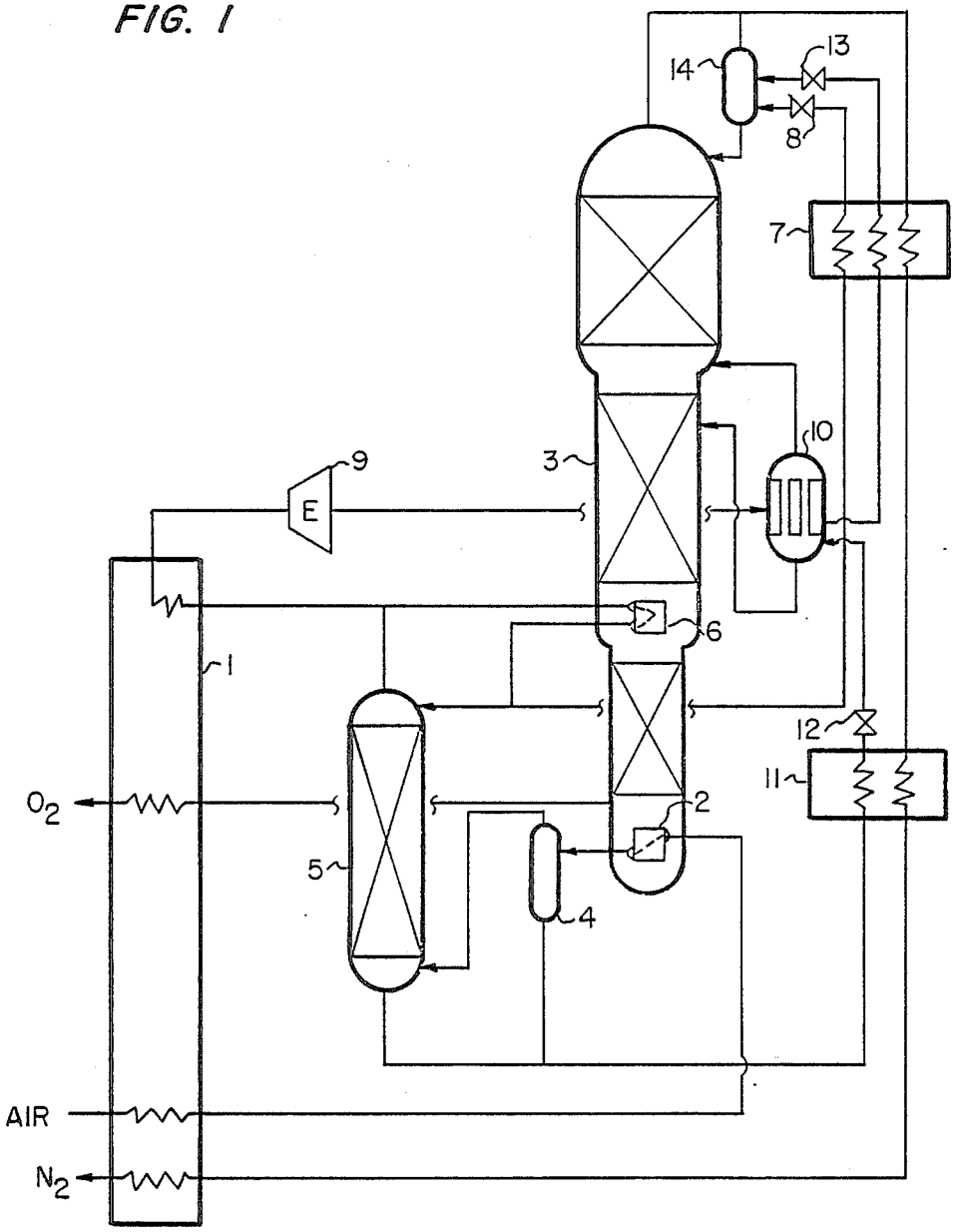
FIGS. 1 through 7 are simplified schematic flowsheets illustrating preferred embodiments or configurations incorporating the disclosed improvement.

Referring to FIG. 1 pressurized supply air is cooled to near its dewpoint in main exchanger 1, which may be any conventional type: reversing, regenerators, brazed plate fin, etc. Also cleanup of moisture, $CO_2$, and hydrocarbons may be via any known technique, e.g., molecular sieve, reversing exchangers, and the like. The air is routed to the bottoms reboiler 2 of LP column 3, where it partially condenses. Optional phase separator 4 directs the uncondensed fraction to HP rectifier 5. Overhead $N_2$ vapor is divided; part is supplied to reboiler 6, from which $LN_2$ is returned to the HP rectifier as reflux, with optionally part also being supplied to reflux the LP column via subcooler 7 and depressurization valve 8. The remaining $N_2$ vapor is superheated sufficiently to avoid condensation during work expansion, and also to compensate for heat exchange inefficiency of exchanger 1. It is then work expanded in expander 9 and supplied to $N_2$ condenser 10. If the expander exhaust temperature is close to the dewpoint, the partially depressurized $N_2$ is directly supplied to 10; otherwise it may be sensibly cooled first. At condenser 10, kettle liquid which has been cooled in sensible heat exchanger 11 and depressurized by valve 12 is at least partially evaporated, and then fed to LP column 3. The resulting liquid $N_2$ is cooled in subcooler 7, depressurized by valve 13, phase separated at separator 14, and directly injected into LP column 3 as overhead reflux. Gaseous $N_2$ is withdrawn from LP column 3 and vented or put to other use, and product low purity $O_2$ (e.g., about 90 to 97% purity) is evaporated by reboiler-/evaporator 2 and withdrawn.

Figure 2:
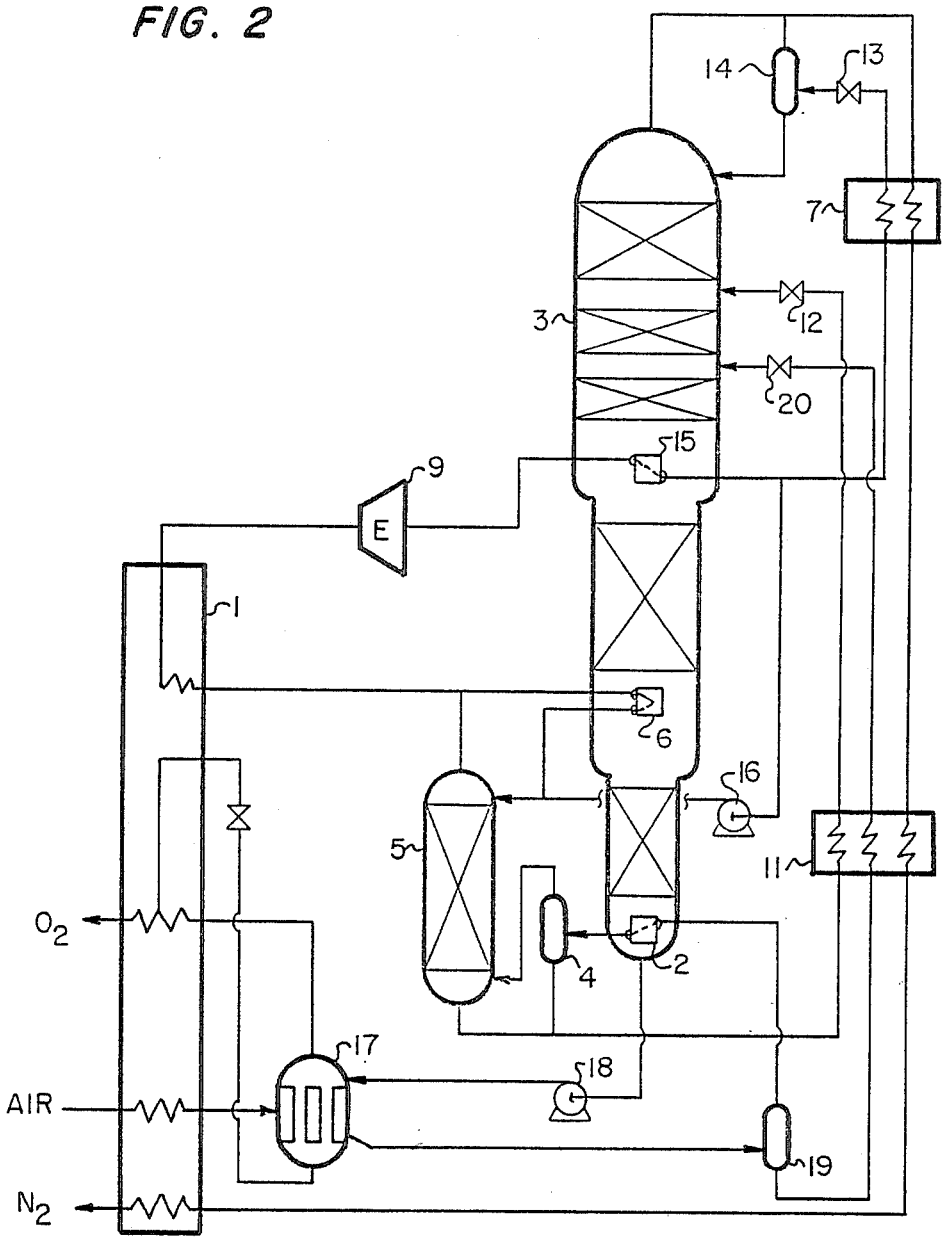

In FIG. 2, also for production of low purity $O_2$, the changes from FIG. 1 are as follows. First, rather than intermediate reboiler 6 producing more $LN_2$ than required for HP rectifier reflux, it produces less, and hence some of the intermediate pressure $LN_2$must be supplied by pump 16. Secondly, the partially depressurized $N_2$ condenses by heat exchange with LP column intermediate height liquid in intermediate reboiler 15, vice with kettle liquid in heat exchanger 10. Thirdly, product $O_2$ evaporation in Lox evaporator 17 is conducted separately from LP column bottoms reboil in reboiler 2, rather than together. Thus means for supplying liquid oxygen to evaporator 17 is required, i.e., a check valve, or pump 18, or barometric leg, or the like. Phase separator 19 then routes the condensate from evaporator 17 to the LP column via valve 20.

Figure 3:
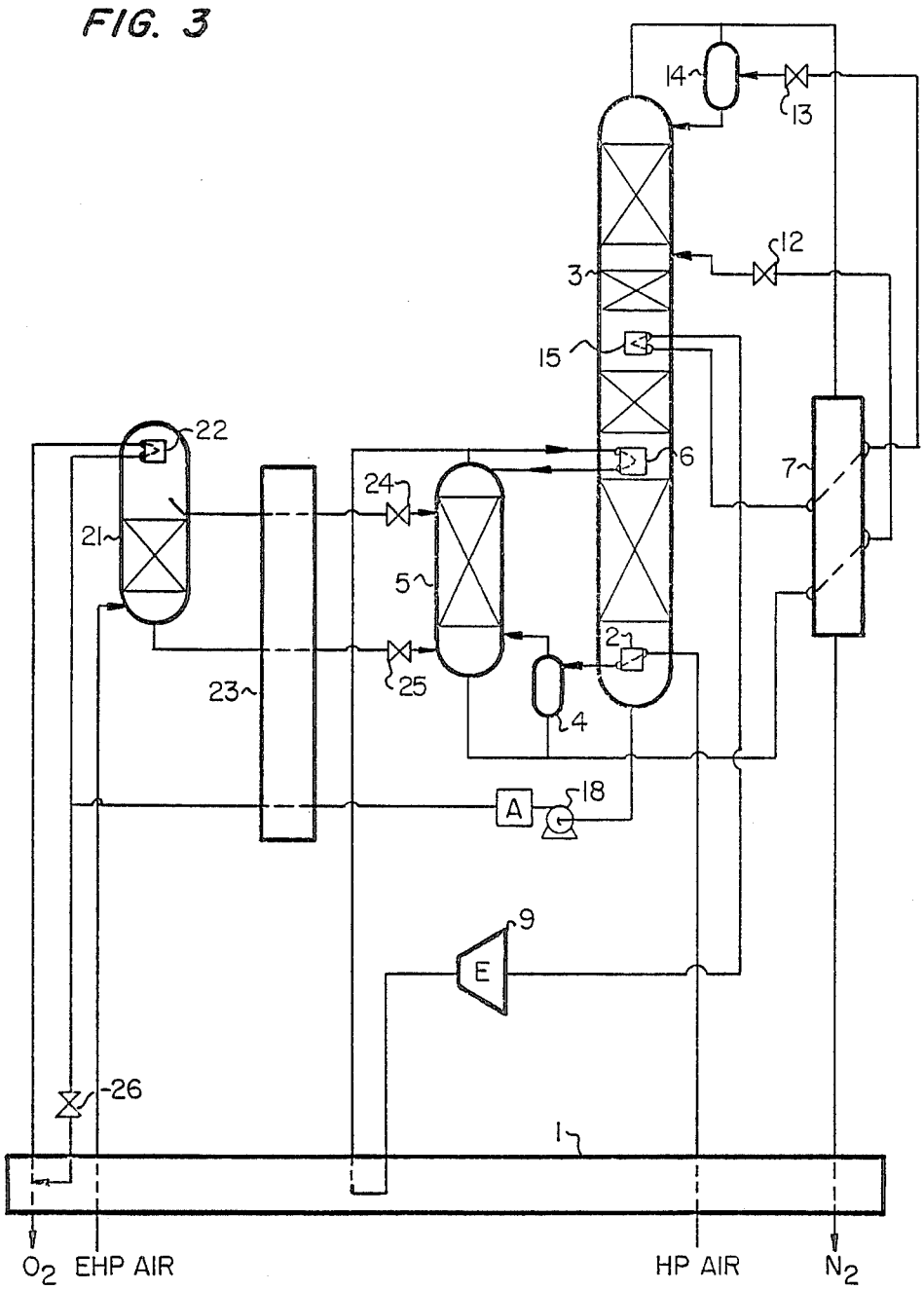

In FIG. 3, the basic embodiment or arrangement according to FIG. 2 is combined with the technique disclosed in U.S. Pat. No. 4,604,116 for producing high pressure oxygen product at high energy efficiency and yield and without a separate oxygen compressor. A minor fraction of the supply air is supplied at elevated pressure to extra high pressure (EHP) rectifier 21, which is refluxed by latent heat exchange with boiling pumped LOX in evaporator 22. The pumped LOX exchanges sensible heat with both overhead $N_2$ and kettle liquid from rectifier 21, in exchanger 23. the latter streams ae then depressurized by valves 24 and 25 respectively and undergo further separation in rectifier 5 and/or column 3. A minor stream of liquid oxygen may optionally bypass evaporator 22 via valve 26.

Figure 4:
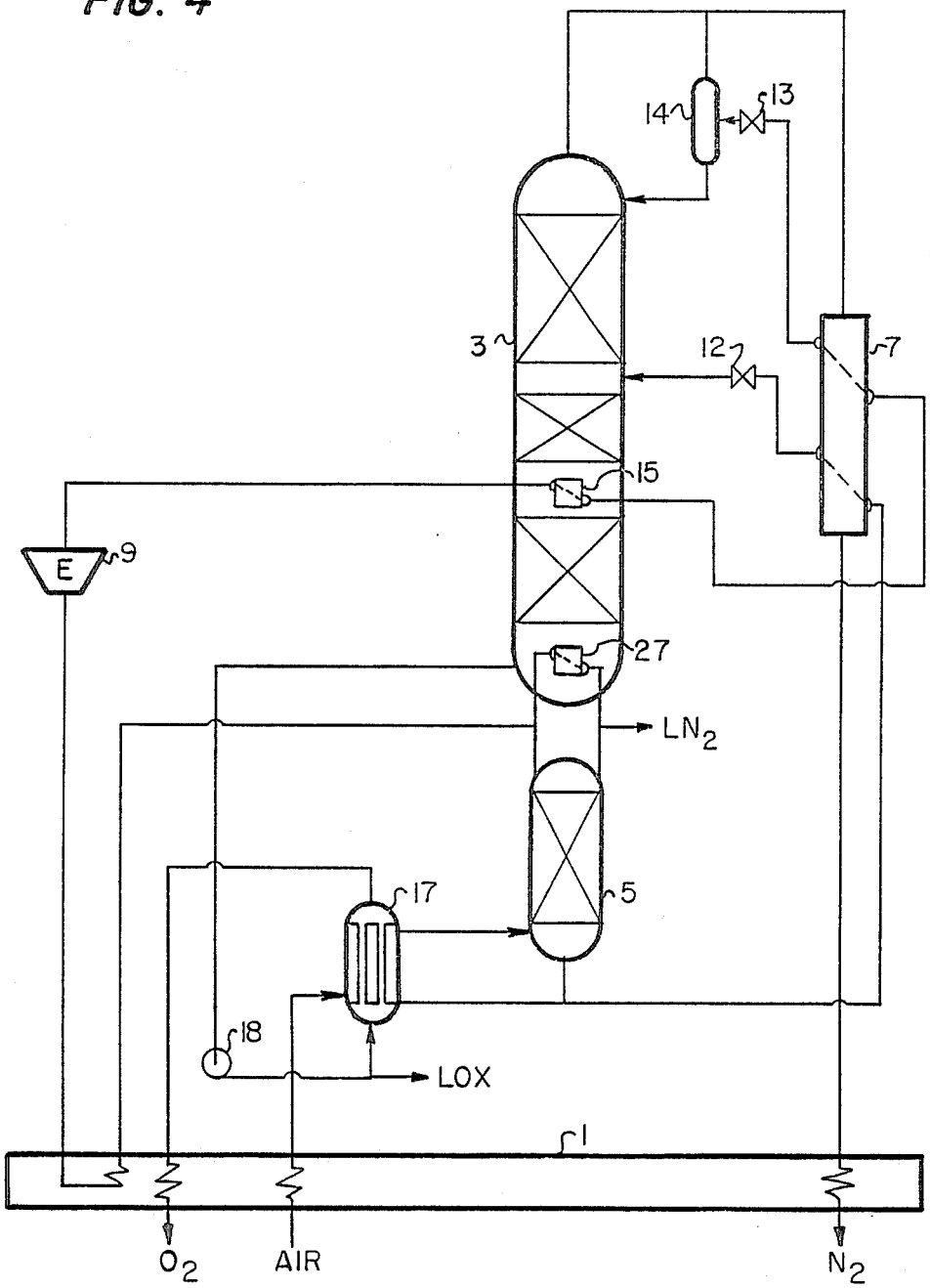

FIG. 4 illustrates the use of NIPER in a more conventional dual pressure column configuration wherein the objective is to increase the yield of coproducts rather than decrease the air supply pressure as in FIGS. 1–3. As with all the flowsheets, numbered items which repeat earlier numbers have descriptions substantially the same as already described. The differences of FIG. 4 from FIG. 2 are that the LP column 3 is reboiled at the bottom by reboiler 27 which exchanges latent heat directly with HP rectifier overhead $N_2$ i.e., before partial depressurization. This makes it possible to additionally withdraw substantial amounts of one or more coproducts, as indicated: liquid oxygen, liquid nitrogen, and/or high pressure gaseous nitrogen.

Figure 5:
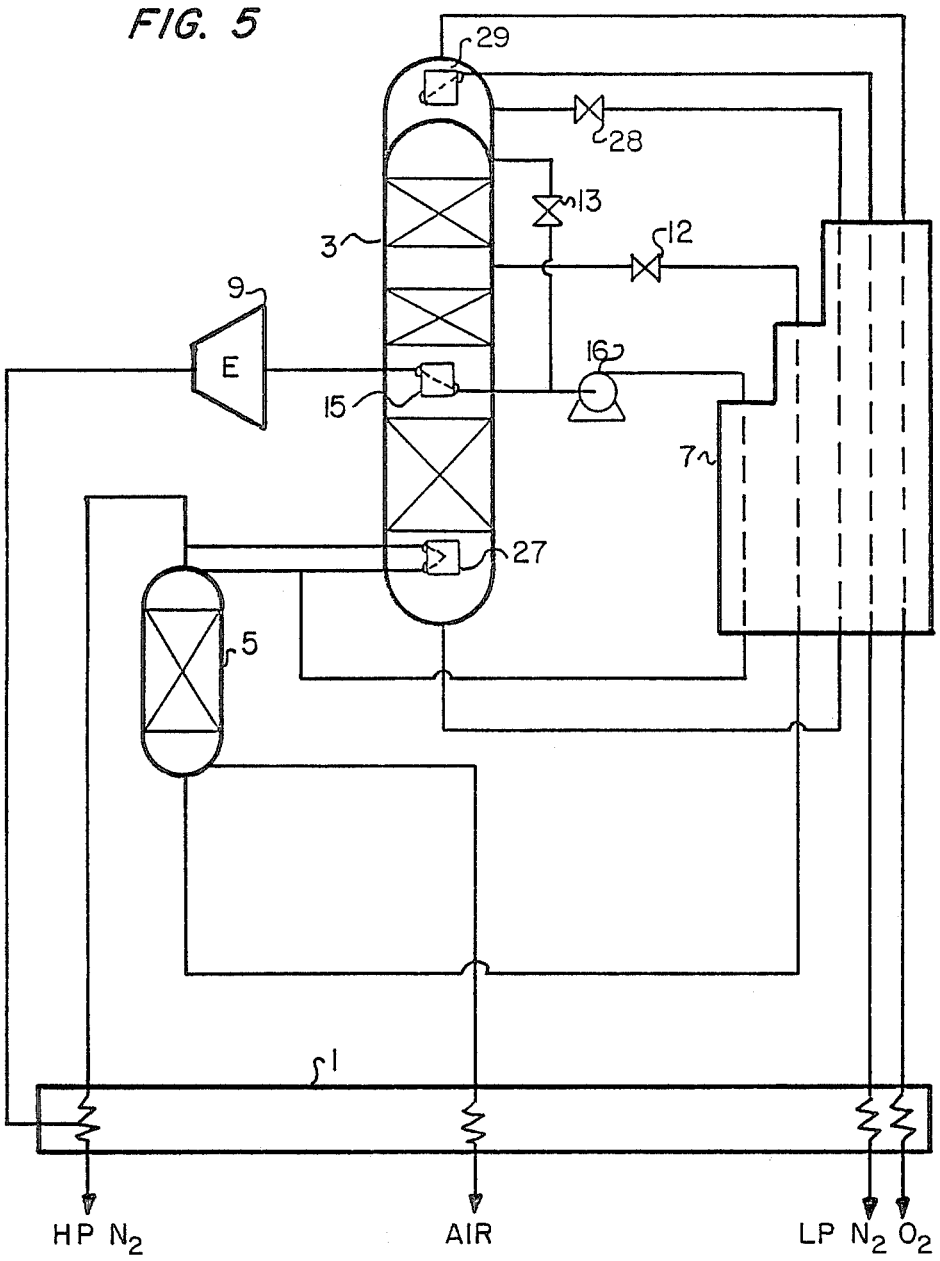

FIG. 5 is a further adaptation of FIG. 4 so as to produce high purity nitrogen as the major product instead of low purity oxygen, while using NIPER. The essential additional features are that impure liquid oxygen from the bottom of column 3 is depressurized by valve 28 and then supplied to latent heat exchanger 29, thereby providing the large amount of $LN_2$ reflux necessary for high purity $N_2$ plants. Product $N_2$ is withdrawn both from the HP rectifier and LP column overheads. Typical operating conditions for FIG. 5 are HP rectifier pressure about 135 to 150 psia, LP column pressure about 55 to 60 psia, $N_2$ recovery of about 0.7 to 0.72 moles per mole of compressed air, and $N_2$ intermediate pressure of about 95 to 120 psia.

Figure 6:
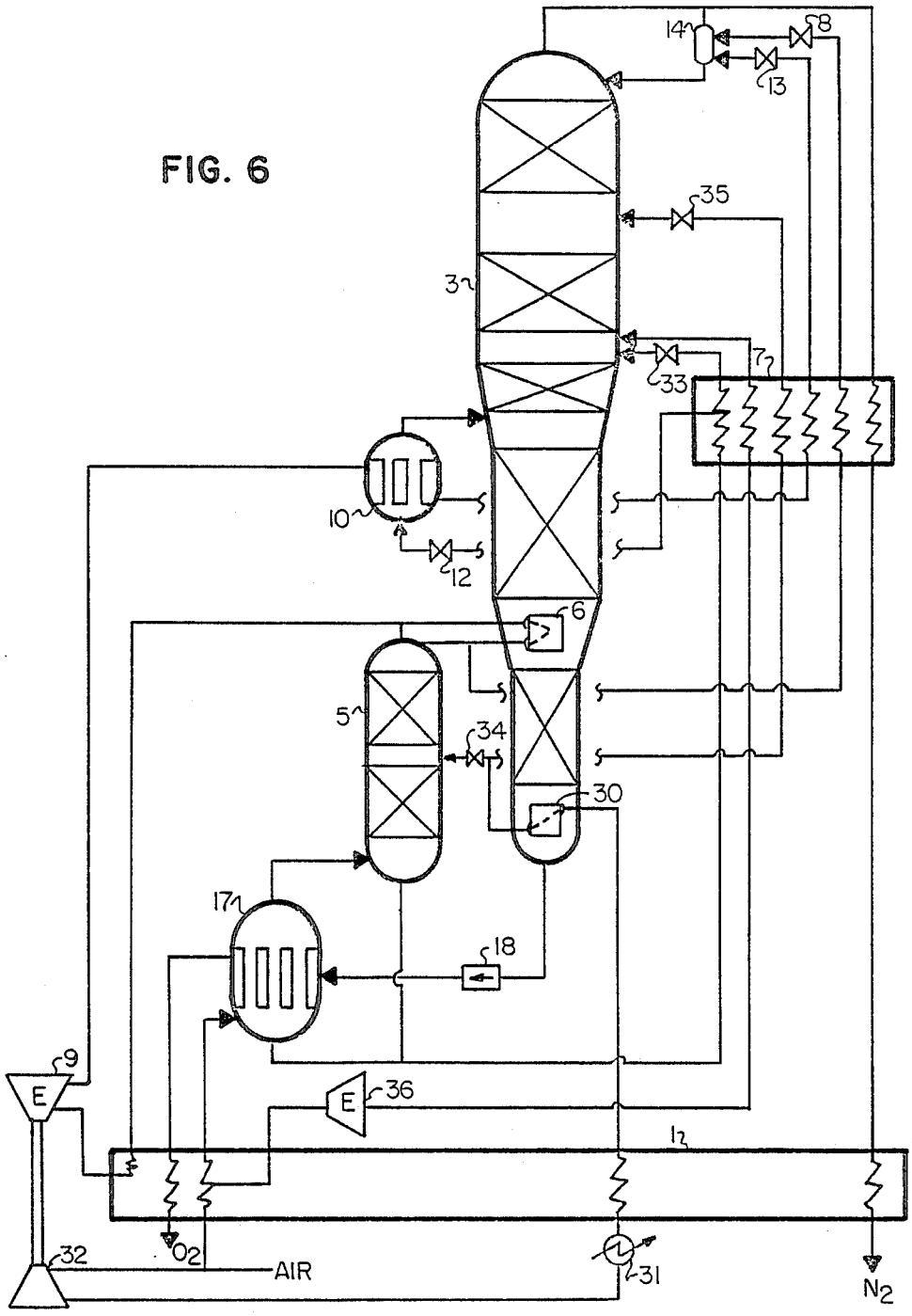

FIG. 6 illustrates an extremely low energy, high efficiency arrangement made possible by NIPER for producing low purity oxygen. It differs most importantly from FIGS. 1 and 2 in that LP column 3 is bottom reboiled by total condensation of a minor fraction of the supply air in reboiler 30, and that fraction is compressed to above supply pressure by warm compressor 32 which is powered by expander 9. The compression heat may be removed by cooler 31. The extra pressure lets reboiler 30 operate at about the same temperature as reboiler 2 even though the HP rectifier 5 is about 2° F. to 3° F. cooler, and hence the required air supply pressure decreases from about 65 psia to about 59 psia (the rectifier pressure is about 6 psia lower than the supply pressure when using molecular sieves). Other beneficial efficiency and recovery-enhancing features illustrated by FIG. 6 include a split of the liquid air by coordinated action of valves 34 and 35 so as to provide intermediate reflux to both rectifier 5 and column 3; a split of kettle liquid by coordinated action of valves 12 and 33 so as to provide just sufficient kettle liquid to $N_2$ condenser 10 for total evaporation, and the remainder directly to column 3 as liquid; and finally a supplemental expander 36 performing conventional expansion of air (or alternatively of $N_2$) for those flowsheets wherein expander 9 cannot provide all required refrigeration.

Figure 7:
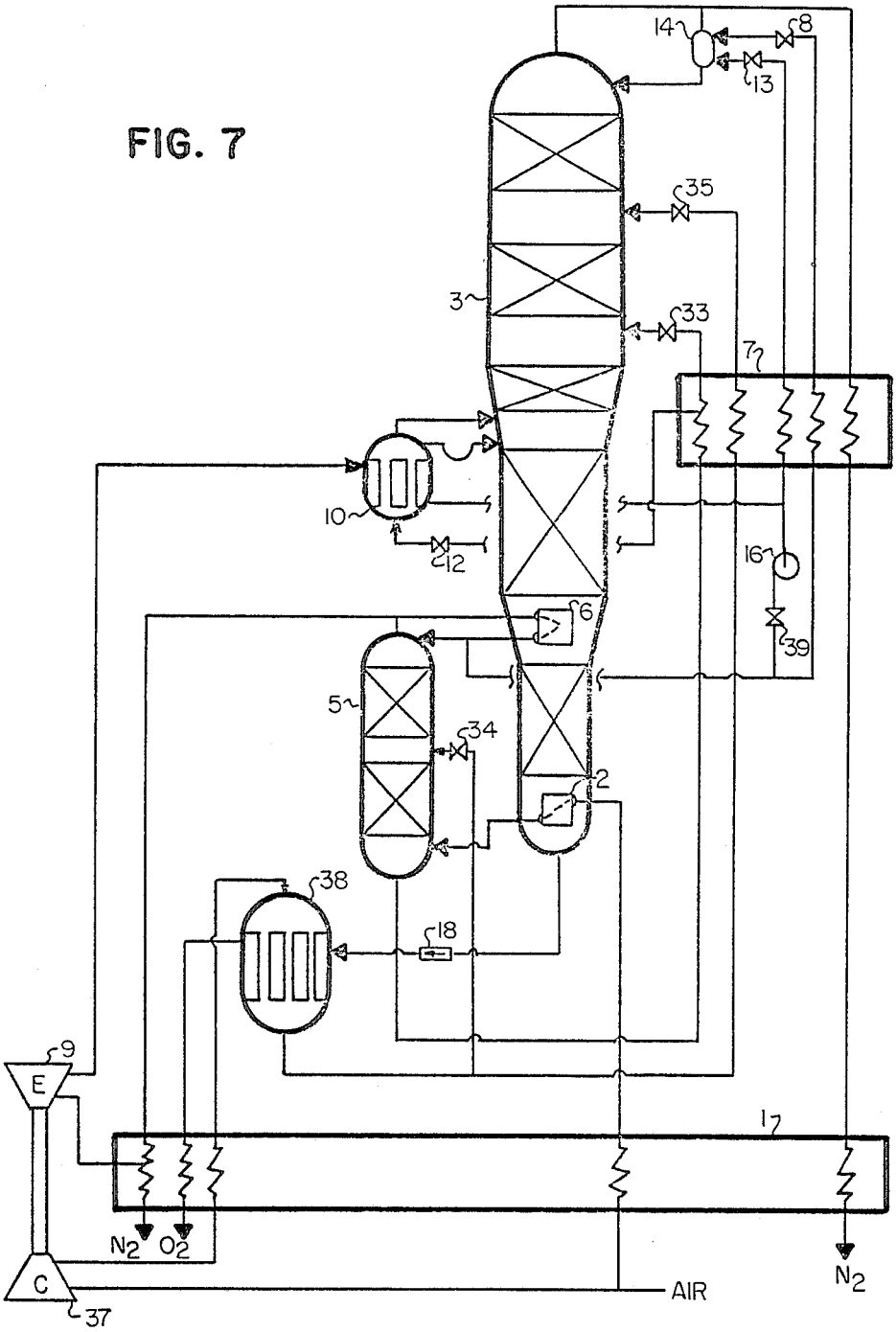

FIG. 7 incorporates features of FIG. 6 and of Figures 1 and 2. Once again it reflects an extremely efficient process, but the objective here is to increase byproduct yield (e.g., HP $N_2$) rather than decrease supply air pressure as in FIG. 6. The differences from FIG. 6 are that column 3 reboil is by partial condensation of feed air in reboiler 2,; and a minor supply air fraction is further compressed in compressor 37 and totally condensed in Lox evaporator 38 to evaporate LOX. Also $LN_2$ can be transferred in either direction, either from condenser 6 to LP overhead via valve 8 or from condenser 10 to HP rectifier overhead via valve 39 and pump 16, thus providing maximum flexibility, e.g., allowing different rates of coproduct withdrawal.

It will be recognized that either or both NIPER variations can be incorporated in any of the above figures. All of the figures except FIGS. 4 and 5 reflect very high efficiency LP columns in which in addition to bottoms reboil, the reboil rate is further increased at two different vertically spaced heights. For FIG. 4 it will be apparent that a second NIPER can be added to column 3 at a different height than condenser 15, using, for example, a kettle liquid boiling condenser 10 and a second expander discharging at a different intermediate pressure. The second expander can increase the refrigeration output, thus allowing withdrawal of more liquid coproduct, or alternatively could power a cold compressor so as to further increase $O_2$ delivery pressure. Alternatively other known intermediate reboiler configurations could be added to FIG. 4 besides NIPER.

The various other energy-reducing and recovery-enhancing techniques illustrated in FIGS. 1–7 can similarly be applied independently or in other combinations. Many more possible advantageous combinations and variations within the scope of the disclosed invention will occur to the artisan beyond those presented, and the intended scope is to be only limited by the claims.

The $N_2$ intermediate pressure from expander 9 will normally be at least 1.5 times the LP column pressure, and more typically 2 times.

I claim:

1. A process for obtaining at least one of oxygen and nitrogen from pressurized, cooled, and cleaned supply air by cryogenic distillation in an apparatus comprised of at least a high pressure rectifier and a low pressure distillation column, comprising:

(a) introducing at least part of a vapor obtained from said supply air into the HP rectifier;

(b) withdrawing pressurized gaseous nitrogen from the HP rectifier and superheating it;

(c) partially expanding the superheated nitrogen to an intermediate pressure;

(d) condensing said partially expanded nitrogen by latent heat exchange with at least one of LP distillation column intermediate height liquid and at least part of the depressurized kettle liquid;

(e) refluxing at least one of the HP rectifier and the distillation column by direct injection of the condensed nitrogen.

2. Process according to claim 1 wherein all of said latent heat exchange is with said depressurized kettle liquid.

3. Process according to claim 1 further comprising evaporating LP column bottom product at a pressure no lower than said LP column pressure.

4. Process according to claim 3 further comprising partially condensing supply air in latent heat exchange with LP column bottom liquid, and providing remaining uncondensed fraction as said vapor introduced to the HP rectifier.

5. Process according to claim 3 further comprising splitting rectifier liquid bottom product kettle liquid into two fractions, supplying the major fraction to said $N_2$ condensing heat exchange and supplying the minor fraction to the LP column as liquid.

6. Process according to claim 3 further comprising supplying at least a major fraction of said supply air directly to said HP rectifier as said introduced vapor.

7. Process according to claim 3 further comprising: increasing the reboil of the LP column at an intermediate height by said $N_2$ condensing step; and separately increasing the LP column reboil at a different intermediate height by an intermediate reboiler.

8. Process according to claim 3 further comprising reboiling LP column bottom liquid by exchanging latent heat with a totally condensing minor fraction of said supply air which has been additionally compressed to above supply pressure.

9. Process according to claim 8 further comprising: powering said additional compression by said work expansion; and splitting the liquid air condensate and providing intermediate reflux to both the LP column and HP rectifier therefrom.

10. A dual pressure cryogenic distillation apparatus designed and dimensioned for air separation comprised of:

(a) high pressure rectifier;

(b) low pressure distillation column;

(c) conduit and heat exchange means for withdrawing gaseous $N_2$ from said HP rectifier and controllably superheating it;

(d) expander for partially depressurizing said superheated $N_2$ while producing refrigeration and power;

(e) latent heat exchanger for condensing said expanded $N_2$and providing additional reboil to an intermediate height of said LP column by evaporating depressurized kettle liquid; and (f) means for introducing the condensed $N_2$ into the overhead of at least one of the HP rectifier and the LP column as reflux therefor.

11. Apparatus according to claim 10 further comprised of LP column bottoms reboiler in which latent heat is exchanged with partially condensing supply air.

12. Apparatus according to claim 10 further comprised of LP column bottoms reboiler in which latent heat is exchanged with a minor fraction of supply air which is totally condensed thereby.

13. Apparatus according to claim 10 further comprised of a warm compressor powered by said expander which additionally compresses a minor fraction of supply air, means for totally condensing said supply air, and means for supplying the liquid air to intermediate reflux heights of both the HP rectifier and LP column.

14. Apparatus according to claim 10 further comprised of: LP column bottoms reboiler which exchanges latent heat with HP rectifier overhead $N_2$ at HP rectifier pressure; and means for dividing HP rectifier kettle liquid into two fractions, one for said $N_2$ condenser, and one for feed as liquid to said LP column.

15. Apparatus according to claim 14 further comprised of: means for indirect latent heat exchange refluxing of LP column overhead; means for supplying depressurized LP column bottom liquid to said LP column overhead refluxer; and means for withdrawing high purity $N_2$ product from the overhead of both the HP rectifier and LP column.

16. Apparatus according to claim 10 further comprised of an intermediate reboiler for the LP column at a different intermediate height from that associated with said latent heat exchanger.

17. Apparatus according to claim 16 wherein said intermediate reboiler exchanges latent heat with HP rectifier gaseous $N_2$ before depressurization.

18. Apparatus according to claim 16 wherein said intermediate reboiler exchanges latent heat with HP rectifier gaseous $N_2$ which has been partially depressurized to a different pressure than that associated with said latent heat exchanger.

19. In a subambient distillation apparatus designed, dimensioned, and adapted for separation of at least one of nitrogen and oxygen from cleaned and cooled air, and comprised of high pressure rectifier and low pressure column, the improvement comprising means for providing refrigeration by work expansion of nitrogen vapor comprising:

(a) means for withdrawing HP rectifier overhead nitrogen as vapor and superheating it a controlled amount;

(b) means for expanding said superheated nitrogen to a pressure at least 1.5 times said LP column pressure so as to produce shaft work and refrigeration;

(c) means for condensing said partially expanded nitrogen by exchange of latent heat with at least one of:

(i) LP column intermediate height liquid, and;

(ii) at least part of the HP rectifier kettle liquid bottom product; and (d) means for depressurizing at least part of said condensed $N_2$ to the approximate LP column overhead pressure and injecting it thereto as reflux therefor.

20. Apparatus according to claim 19 further comprised of means for splitting HP rectifier bottom liquid into two fractions, means for supplying one fraction to said means for condensing $N_2$, and means for feeding the remaining fraction to the LP column as liquid.

* * * * *